US007583017B2

(12) United States Patent
Seon

(10) Patent No.: US 7,583,017 B2
(45) Date of Patent: Sep. 1, 2009

(54) ELECTRON EMISSION DISPLAY

(75) Inventor: Hyeong-Rae Seon, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 360 days.

(21) Appl. No.: 11/586,318

(22) Filed: Oct. 24, 2006

(65) Prior Publication Data

US 2007/0145881 A1 Jun. 28, 2007

(30) Foreign Application Priority Data

Oct. 25, 2005 (KR) ..... 10-2005-0100658

(51) Int. Cl.
*H01J 1/62* (2006.01)

(52) U.S. Cl. ..... 313/495; 313/310

(58) Field of Classification Search ..... 313/495–497, 313/306, 309–310, 346, 351, 355, 293–304
See application file for complete search history.

(56) References Cited

U.S. PATENT DOCUMENTS

| | | | | |
|---|---|---|---|---|
| 6,831,402 | B2 * | 12/2004 | Kamiguchi | 313/495 |
| 2003/0160561 | A1 * | 8/2003 | Park et al. | 313/495 |
| 2005/0082963 | A1 * | 4/2005 | Miyazaki et al. | 313/493 |
| 2005/0225229 | A1 * | 10/2005 | Kamiguchi | 313/495 |

* cited by examiner

*Primary Examiner*—Peter J Macchiarolo
*Assistant Examiner*—Donald L Raleigh
(74) *Attorney, Agent, or Firm*—Christie Parker & Hale LLP

(57) ABSTRACT

An electron emission display includes a first substrate and a second substrate facing the first substrate. An electron emission unit is arranged on the first substrate. A light emission unit is arranged on the second substrate, the light emission unit having an anode electrode for accelerating an electron beam emitted from the electron emission unit. A sealing member is adapted to seal an exhaust hole of the first substrate. A voltage supply unit is adapted to apply an anode voltage to the anode electrode via the sealing member.

16 Claims, 6 Drawing Sheets

ELECTRON EMISSION DISPLAY

CROSS-REFERENCE TO RELATED APPLICATION

This application claims priority to and the benefit of Korean Patent Application No. 10-2005-0100658, filed on Oct. 25, 2005, in the Korean Intellectual Property Office, the entire content of which is incorporated herein by reference.

BACKGROUND OF THE INVENTION

1. Field of the Invention

The present invention relates to an electron emission display, and more particularly, to an electron emission display having a structure for applying voltage to an anode electrode for accelerating an electron beam.

2. Description of Related Art

In general, electron emission elements can be classified into those using hot cathodes as an electron emission source and those using cold cathodes as the electron emission source.

There are several types of cold cathode electron emission elements, including Field Emitter Array (FEA) elements, Surface Conduction Emitter (SCE) elements, Metal-Insulator-Metal (MIM) elements, and Metal-Insulator-Semiconductor (MIS) elements.

A conventional electron emission display includes an array of electron emission elements arranged on a first substrate and a light emission unit arranged on a second substrate. The light emission unit includes phosphor layers and an anode electrode. The electron emission display further includes electron emission regions arranged on the first substrate and driving electrodes arranged on the first substrate to control electron emission from the electron emission regions. The anode electrode arranged on the second substrate causes electrons emitted from the electron emission regions to be effectively accelerated toward the phosphor layers. Accordingly, the electrons emitted from the electron emission regions excite the phosphor layers to display an image.

The anode electrode receives a direct current voltage of, for example, hundreds to thousands of positive volts that can accelerate the electrons emitted from the first substrate to the second substrate. The voltage is applied from an input terminal. The input terminal extends from the anode electrode to an edge of the second substrate and has a portion arranged outside of a vacuum envelope (or chamber) formed by the first substrate and the second substrate.

Therefore, the second substrate must be provided with a portion on which the input terminal will be arranged. In the conventional electron emission display, one edge of the second substrate protrudes to provide the portion on which the input terminal will be arranged.

As described above, in order to apply the voltage to the anode electrode, the second substrate includes the protruding portion which extends past an opposite edge of the first substrate. Therefore, the protruding portion increases the overall size of the display. However, the protruding portion is a non-effective area in that an image is not displayed at the protruding portion, and therefore increases an amount of dead space.

The input terminal may be arranged on the first substrate in order to reduce the amount of dead space. However, when the input terminal is arranged on the first substrate, one or more extra holes must be formed on the first substrate to connect the input terminal with the anode electrode.

SUMMARY OF THE INVENTION

An aspect of the present invention provides an electron emission display in which an area of a space occupied by an input terminal of an anode electrode is reduced, thereby reducing an area of unnecessary space not used to display an image.

In an embodiment of the present invention, an electron emission display includes a first substrate and a second substrate facing the first substrate. An electron emission unit is arranged on the first substrate. A light emission unit is arranged on the second substrate, the light emission unit having an anode electrode for accelerating an electron beam emitted from the electron emission unit. A sealing member is adapted to seal an exhaust hole of the first substrate. A voltage supply unit is adapted to apply an anode voltage to the anode electrode via the sealing member.

The voltage supply unit may include a connecting member for electrically connecting the sealing member to the anode electrode and a supply member connected to the sealing member to supply the anode voltage to the sealing member.

The connecting member may include a lead line.

The connecting member may be connected with the anode electrode by a first electrically conductive adhesive layer, and the connecting member may be connected with the sealing member by a second electrically conductive adhesive layer.

The connecting member may be an electrically conductive elastic body. The electrically conductive elastic body may be a coil spring or a leaf spring having a bent centerline.

The supply unit may include a lead line connected with the sealing member and arranged on the first substrate.

The lead line may be connected with the sealing member by an electrically conductive adhesive layer.

The sealing member may be formed of an electrically conductive material, metal, or a metal alloy.

The sealing member may be configured to have a hemispherical shape or a substantially flat shape.

The sealing member may be coupled to the first substrate by a frit deposited on a periphery of the sealing member.

The sealing member may be darkened by a heat treatment.

The electron emission unit may include an electron emission region, a plurality of cathode electrodes, and a plurality of gate electrodes arranged to cross the cathode electrodes. The cathode electrodes and the gate electrodes may be insulated from each other and adapted to control the electron emission region. The light emission unit may include a plurality of phosphor layers and a black layer arranged between at least two of the phosphor layers.

The electron emission region may include a material selected from the group consisting of carbon nanotubes, graphite, graphite nanofibers, diamonds, diamond-like carbon, fullerene ($C_{60}$), silicon nanowires, and combinations thereof.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

Figure 1:
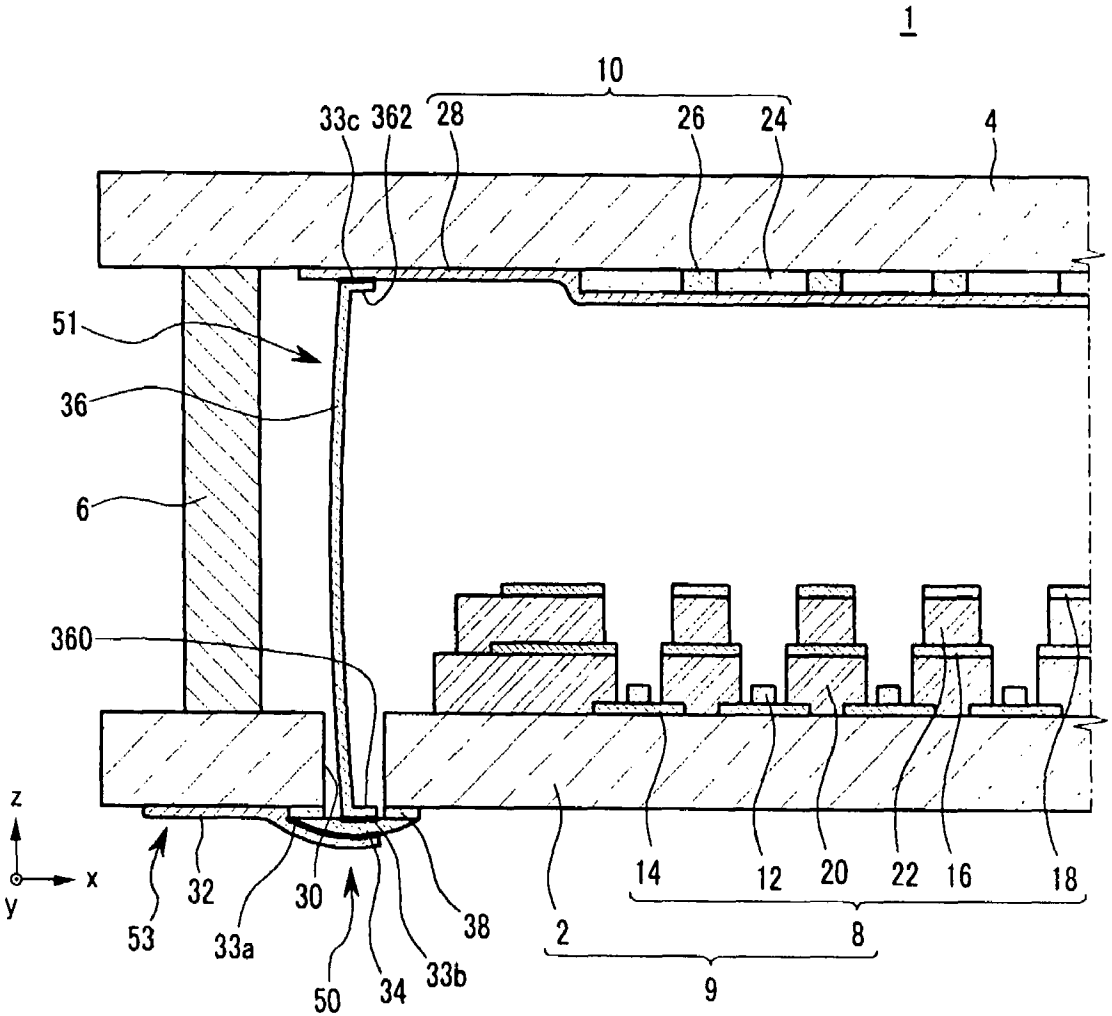
FIG. 1 is a partial sectional view of an electron emission display according to an embodiment of the present invention.
Figure 2:
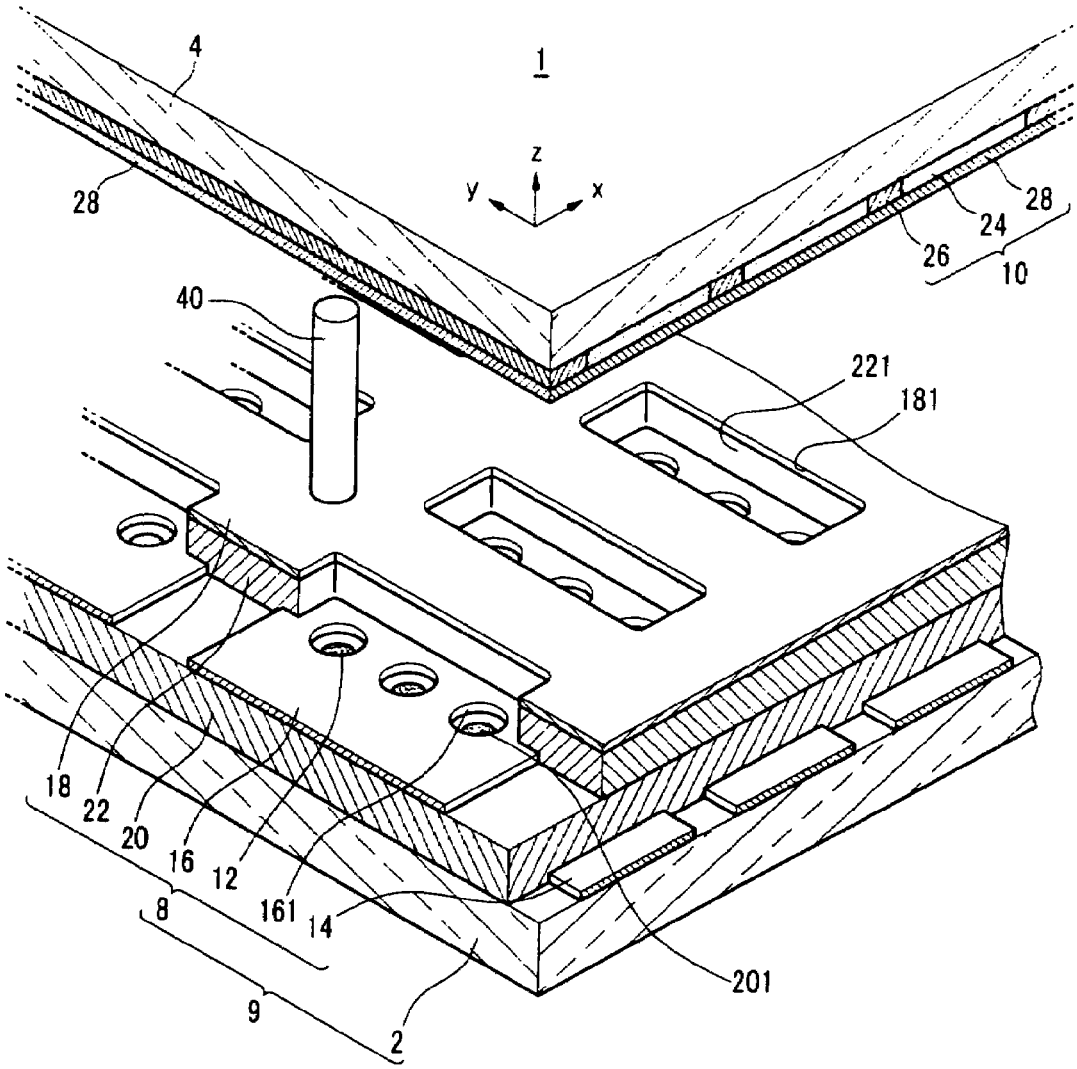
FIG. 2 is a partial exploded perspective view of the electron emission display shown in FIG. 1.
Figure 3:
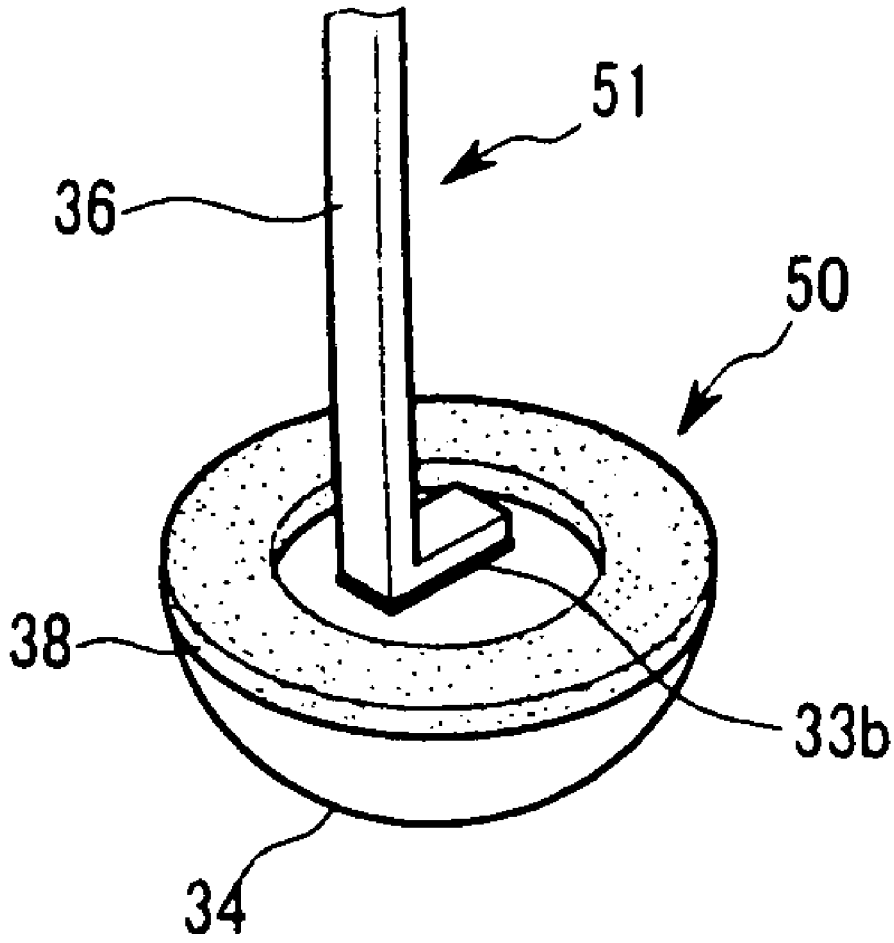
FIG. 3 is a perspective view of a sealing member and a second lead line shown in FIG. 1.

FIG. 1 is a partial sectional view of an electron emission display according to an embodiment of the present invention, FIG. 2 is a partial exploded perspective view of the electron emission display according to the embodiment of the present invention, and FIG. 3 is a perspective view of a sealing member and a second lead line according to the embodiment of the present invention.

Referring to FIGS. 1 and 2, an electron emission display 1 according to an embodiment of the present invention includes a first substrate 2 and a second substrate 4 facing the first substrate 2. The first substrate 2 and the second substrate 4 are spaced apart from each other by a certain (or predetermined) distance therebetween. A frame 6 is arranged at respective peripheries (or peripheral regions) of the first substrate 2 and the second substrate 4 to form an enclosed space. Therefore, the first substrate 2, the second substrate 4, and the frame 6 form a vacuum envelope (or chamber).

An electron emission unit 8 including an array of electron emission elements is arranged on the first substrate 2 to form an electron emission device 9. A light emission unit 10 is arranged on the second substrate 4. The electron emission device 9 is combined with the light emission unit 10 to make the electron emission display 1.

In FIGS. 1 and 2, the electron emission display 1 is shown as having an array of FEA elements.

The electron emission unit 8 includes a plurality of electron emission regions 12 arranged on the first substrate 2 and drive electrodes for controlling electron emission of the electron emission regions 12. The drive electrodes include cathode electrodes 14, gate electrodes 16, and a focusing electrode 18.

The cathode electrodes 14 are arranged in a striped pattern to extend along a first direction (e.g., along a y-axis in FIG. 1), and a first insulation layer 20 is arranged on the first substrate 2 to fully cover the cathode electrodes 14. The gate electrodes 16 are arranged on the first insulation layer 20 in a striped pattern to extend along a second direction (e.g., along an x-axis in FIG. 1) to cross the cathode electrodes 14 at right angles.

Regions at where the cathode electrodes 14 are crossed by the gate electrodes 16 define pixel regions. Each pixel region corresponds to one or more of the electron emission regions 12. Openings 201 and 161 corresponding to the electron emission regions 12 are respectively arranged on the first insulation layer 20 and the gate electrodes 16 to expose the electron emission regions 12. The electron emission regions 12 are formed of a material that emits electrons when an electric field is applied thereto in a vacuum atmosphere. By way of example, the material may be a carbonaceous material and/or a nanometer-sized material. For example, the electron emission regions 12 can be formed of carbon nanotubes, graphite, graphite nanofibers, diamonds, diamond-like carbon, $C_{60}$, silicon nanowires, and/or combinations thereof. Alternatively, the electron emission regions 12 may be formed of a molybdenum-based material and/or a silicon-based material. In this alternative situation, the electron emission regions may be formed to have a pointed-tip structure.

Either the cathode electrodes 14 or the gate electrodes 16 serve as scan electrodes for receiving a scan drive voltage (or voltages), and the other electrodes function as data electrodes for receiving a data drive voltage (or voltages). Electric fields are formed around the electron emission regions 12 where a voltage difference between the cathode electrodes 14 and the gate electrodes 16 is equal to or higher than a threshold value. Electrons are then emitted from the electron emission regions 12.

An embodiment in which the gate electrodes 16 are arranged above the cathode electrodes 14 with the first insulation layer 20 arranged therebetween is illustrated (see, for example, FIGS. 1 and 2). However, embodiments of the present invention are not limited to this embodiment. That is, the cathode electrodes 14 may be arranged above the gate electrodes 16. Accordingly, the electron emission regions may be arranged on the first insulation layer to contact a surface of the cathode electrodes.

A second insulation layer 22 is arranged on the first insulation layer 20 to cover the gate electrodes 16, and the focusing electrode 18 is arranged on the second insulation layer 22. Openings 181 and 221 are respectively arranged on the focusing electrode 18 and the second insulation layer 22 to expose the electron emission regions 12. One of the openings 221 and a corresponding opening of the openings 181 may correspond to one of the pixel regions.

Describing the light emission unit 10 in more detail, phosphor layers 24 and black layers 26 for enhancing a contrast of a displayed image are arranged on a surface of the second substrate 4 facing the first substrate 2 (e.g., one of the black layers 26 is arranged between at least two of the of the phosphor layers 24). An anode electrode 28 is arranged on the phosphor layers 24 and the black layers 26.

The anode electrode 28 heightens a screen luminance by accelerating electron beams and reflecting visible light rays radiated from the phosphor layers 24 to the first substrate 2 back toward the second substrate 4.

The anode electrode 28 may be a metal layer formed, by way of example, of aluminum. Alternatively, the anode electrode may be a transparent conductive layer formed, by way of example, of indium tin oxide (ITO). In this alternative situation, the anode electrode is arranged on respective surfaces of the phosphor layers 24 and the black layers 26, which face the second substrate 4.

An exhaust hole 30 (see, for example, FIG. 1) is arranged on the first substrate 2 to exhaust (or evacuate) air from inside the vacuum envelope, and the exhaust hole 30 is sealed with a sealing member 34 after an evacuation process is performed.

A voltage supply unit 50 is arranged on the first substrate 2. The voltage supply unit 50 applies a drive voltage to the anode electrode 28 from an electric power source arranged outside of the vacuum envelope.

As shown in FIG. 1, the voltage supply unit 50 includes a connecting member 51 and a supply member 53. The connecting member 51 electrically interconnects the anode electrode 28 and the sealing member 34, and the supply member 53 provides the drive voltage to the sealing member 34.

The supply member 53 may include a first lead line 32, and the connecting member 51 may include a second lead line 36.

One end of the first lead line 32 is connected with the external electric power source, and the sealing member 34 is connected with the first lead line 32 at an opposite end of the first lead line 32. The first lead line 32 may contact the sealing member 34 over a relatively large contact area in order to reduce a level of contact resistance. A first electrically conductive adhesive layer 33*a* may be arranged between the sealing member 34 and the first lead line 32 to enhance an adhesive force between the sealing member 34 and the first lead line 32, and the first electrically conductive adhesive layer 33*a* may be formed of an electrically conductive adhesive to allow a current generated by the drive voltage to flow through the first electrically conductive adhesive layer 33*a*.

The sealing member 34 may be coupled to the first substrate 2 via a frit 38, and the frit 38 may be arranged on a periphery (or peripheral region) of the sealing member 34 so as not to hinder a coupling between the second lead line 36 and the sealing member 34. After the sealing member 34 is coupled with the second lead line 36, the sealing member 34 may be darkened by a heat treatment at a temperature of about 950° C. The heat treatment of the sealing member 34 creates an oxidized layer, of a material such as $Cr_2O_x$, on a surface of the sealing member 34, thereby reinforcing the coupling (or bond) between the frit 38 and the sealing member 34. The reinforced coupling (or bond) between the frit 38 and the sealing member 34 reduces a risk of or prevents an occurrence of a vacuum leak more effectively.

As shown in FIG. 3, the sealing member 34 may be configured to have a hemispherical shape. However, embodiments of the present invention are not limited to this case. By way of example, the sealing member 34 may be configured to have a substantially flat shape, and a top surface of the sealing member may be circular or polygonal in shape. The sealing member 34 may be formed of a conductive material, such as metal or a metal alloy, in order to allow a current to flow through the sealing member 34.

As shown in FIG. 1, the anode electrode 28 and the sealing member 34 are interconnected by the second lead line 36. The second lead line 36 is coupled with the sealing member 34 over a first contact surface 360, and the second lead line 36 is coupled with the anode electrode 28 over a second contact surface 362. Each of the first contact surface 360 and the second contact surface 362 may be configured in order to reduce respective levels of contact resistance. A second electrically conductive adhesive layer 33*b* may be arranged between the sealing member 34 and the second lead line 36 at the first contact surface 360. A third electrically conductive adhesive layer 33*c* may be arranged between the anode electrode 28 and the second lead line 36 at the second contact surface 362. Silver (Ag) paste may be used to form the second electrically conductive adhesive layer 33*b* and the third electrically conductive adhesive layer 33*c*.

The first lead line 32 and the second lead line 36 may be formed of any of a variety of conductive materials such as Cr, Al, Ag, ITO, or combinations thereof.

The drive voltage is applied from the external electric power source to the anode electrode 28 in the following order: from the external electric power source to the first lead line 32, then to the first electrically conductive adhesive layer 33*a*, then to the sealing member 34, then to the second electrically conductive adhesive layer 33*b*, then to the second lead line 36, then to the third electrically conductive adhesive layer 33*c*, and then to the anode electrode 28.

Because the drive voltage is applied to the anode electrode 28 via the sealing member 34, there is no need to extend the second lead line 36, which effectively connects the anode electrode to the external electric power source, outside of the vacuum envelope and through the sealing member 34 used for sealing the exhaust hole 30 on the first substrate 2.

Therefore, a risk of leakage from inside the vacuum envelope of the electron emission display 1 can be reduced.

In a further embodiment, the anode electrode 28 can be connected to the external electric power source via the exhaust hole 30, which is already formed to exhaust internal gas out from the vacuum envelope, without using any additional holes. Therefore, a manufacturing process can be simplified.

A plurality of spacers 40 may be arranged between the first substrate 2 and the second substrate 4 to uniformly maintain a certain (or predetermined) gap between the first substrate 2 and the second substrate 4 to counter an application of an external force. The spacers 40 may be configured to have a shape of a cylindrical post (e.g., a post having a circular cross section) or a rectangular post (e.g. a post having a rectangular cross section).

Figure 4:
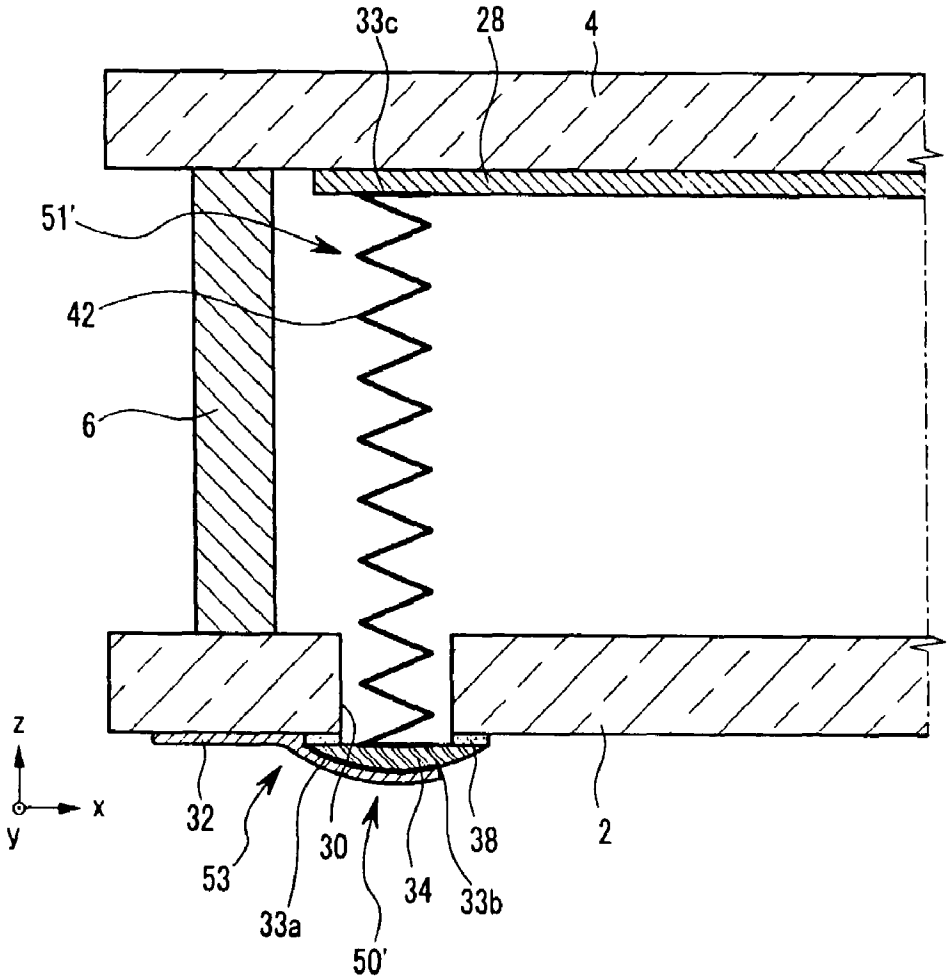
FIG. 4 is a partial sectional view of an electron emission display according to another embodiment of the present invention.
Figure 5:
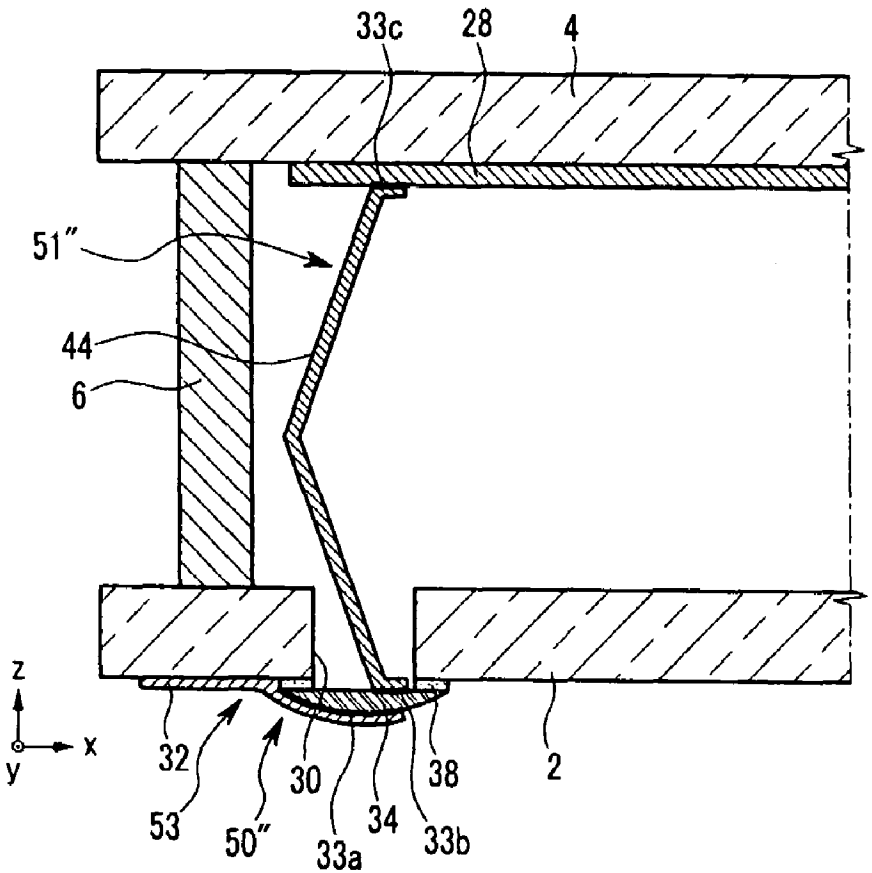
FIG. 5 is a partial sectional view of an electron emission display according to another embodiment of the present invention.

FIGS. 4 and 5 are partial sectional views of electron emission displays according to other embodiments of the present invention.

Electron emission displays of these other embodiments are substantially identical to that of the foregoing embodiment with the exception of the connection member of the voltage supply unit. Therefore, the same reference numbers will be used to refer to corresponding elements of the foregoing embodiment, and only the connection member will be described in more detail below.

Referring first to FIG. 4, a connecting member 51' may be formed by a coil spring. Alternatively, as shown in FIG. 5, a connecting member 51" may be formed by a leaf spring having a bent centerline.

However, embodiments of the present invention are not limited to the examples described above. That is, any of various suitable electrically conductive elastic structures can be used to form the connecting member.

When the connecting members 51' and 51" are formed of an electrically conductive elastic structure as described above, the connecting members 51', 51" can better elastically absorb shock energy originating from inside or outside of the vacuum envelope, as compared to an electron emission display not including the respective structure(s) shown in FIG. 4 and/or FIG. 5. Therefore, when either one of the connecting members 51' and 51" is coupled to the anode electrode 28 and the sealing member 34, the either one of the connecting members 51' and 51" prevents or restrains movements of the anode electrode 28 and the sealing member 34 away from their respective positions caused by shock energy.

In the embodiments of the present invention described, an electron emission display has an array of FEA elements. However, embodiments of the present invention are not limited to this situation. For example, embodiments of the present invention can also be applied to an electron emission display having an array of SCE elements, MIM elements, and/or MIS elements.

Figure 6:
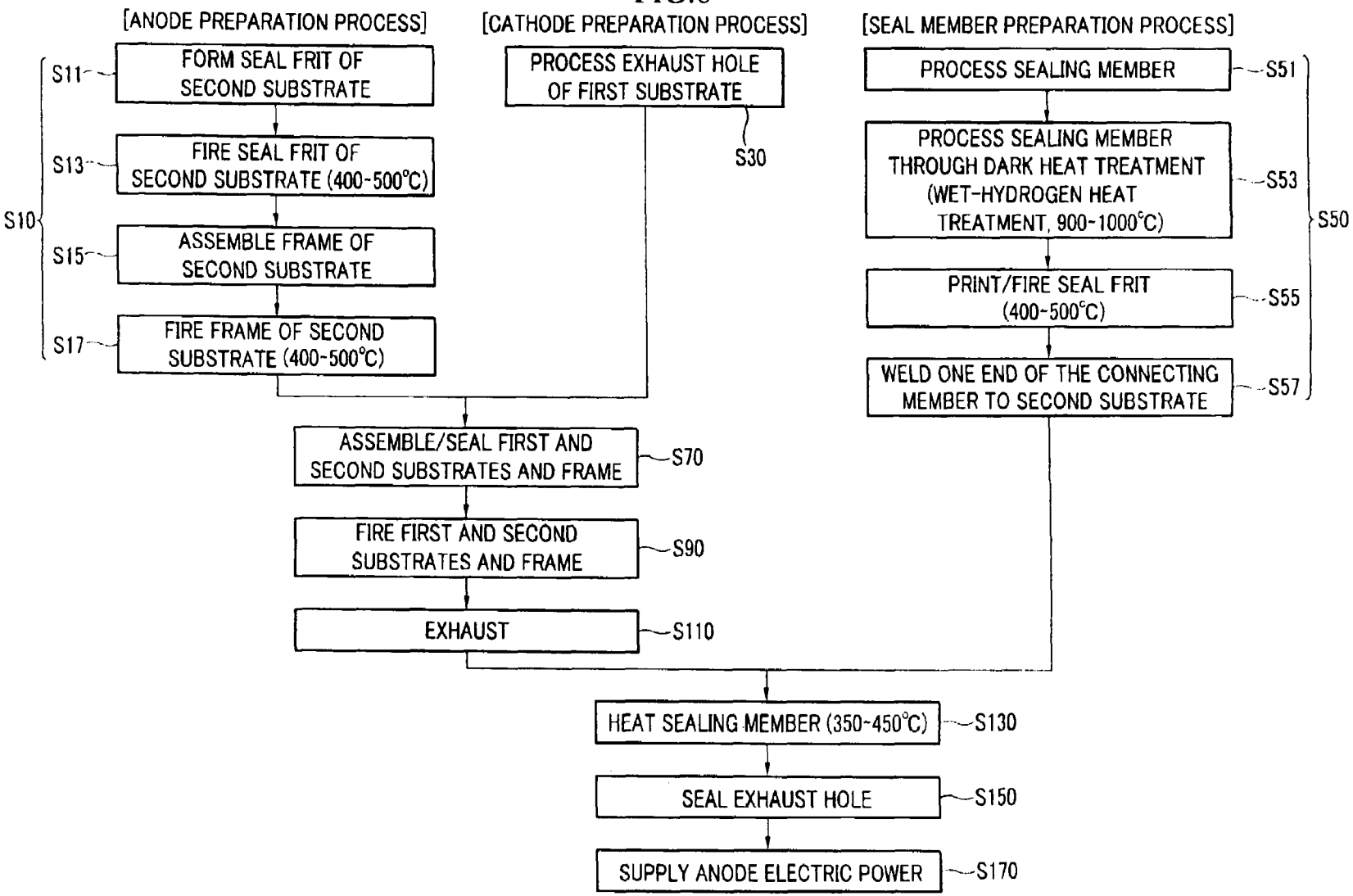
FIG. 6 is a flowchart illustrating a method of manufacturing an electron emission display according to an embodiment of the present invention.

FIG. 6 is a flowchart illustrating a method of manufacturing an electron emission display according to an embodiment of the present invention. The electron emission display shown in FIG. 1 is used to describe the method shown in FIG. 6.

Referring to FIG. 6, a method of manufacturing the electron emission display includes performing an anode preparation process S10, performing a cathode preparation process S30, and performing a seal member preparation process S50.

In the anode preparation process S10, a seal frit is deposited on the periphery (or peripheral region) of the second substrate 4 on which the light emission unit 10 is coupled with the second lead line 36 (S11), and the seal frit is fired at a temperature within a range from about 400 to about 500° C. (S13). Then, the frame 6 is arranged on the seal frit (S15), fired at a temperature within a range from about 400 to about 500° C., and adhered to the second substrate 4 (S17).

In the cathode preparation process S30, the exhaust hole 30 is formed on the first substrate 2 on which the electron emission unit 8 is arranged.

In the sealing member preparation process S50, the sealing member 34 is arranged (S51) and darkened through a heat treatment process (S53). Then, a seal frit 38 is deposited and fired around the exhaust hole 30 of the first substrate 2 (e.g. at a temperature within a range from about 400 to about 500° C.) (S55). The heat treatment process may be conducted by hydrogen-wet heat treatment at a temperature within a range from about 900 to about 1000° C. (S57). Next, the anode electrode 28 is connected to one end of the second lead line 36 via the third electrically conductive adhesive layer 33*c* (S57).

After the above processes are performed, a seal frit is deposited on one end of the frame 6, the one end not being coupled to the second substrate 4, and the first substrate 2 and the second substrate 4 are joined by the frame 6 (S70). Alternatively, the seal frit may be deposited on the first substrate 2 rather than on the frame 6.

Then, the vacuum envelope composed of the first substrate 2, the second substrate 4, and the frame 6 is fired, by way of example, at a temperature within a range from about 400 to about 500° C. Here, the opposite end of the second lead line 36 (that is, the portion of the connection member 51 connected to the second substrate 4) extends through the exhaust hole 30.

Then, internal air is exhausted out from the vacuum envelope through the exhaust hole 30 (S110).

Then, the sealing member 34 is connected with the second lead line 36 via the second electrically conductive adhesive layer 33*b* and, at substantially the same time, the sealing member 34 is adhered to the first substrate 2 via the frit 38 in order to seal the exhaust hole 30. Then, the sealing member 34 is heated, by way of example, at a temperature within a range from about 350 to about 450° C. (S130) so that the vacuum envelope is properly sealed by the sealing member 34 (S150).

Then, when the drive voltage is applied to the first lead line 32 (S170), the drive voltage is applied to the anode electrode 28 via the following sequence: from the first lead line 32 to the first electrically conductive adhesive layer 33*a*, then to the sealing member 34, then to the second electrically conductive adhesive layer 33*b*, then to the second lead line 36, then to the third electrically conductive adhesive layer 33*c*, and then to the anode electrode 28.

According to embodiments of the present invention, in the electron emission display 1, the drive voltage is applied to the anode electrode 28 via the sealing member 34. Therefore, space occupied by the input terminal is minimized without forming an additional hole for extending the second lead line 36 from the anode electrode 28 to the external electric power source. Also, because the frit 8 arranged on the sealing member 34 and the second electrically conductive adhesive layer 33*b* do not overlap with each other, a tight sealing of the vacuum envelope can be ensured.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An electron emission display, comprising:

a first substrate;

a second substrate facing the first substrate;

an electron emission unit arranged on the first substrate;

a light emission unit arranged on the second substrate, the light emission unit having an anode electrode for accelerating an electron beam emitted from the electron emission unit;

a sealing member for sealing an exhaust hole of the first substrate; and a voltage supply unit adapted to apply an anode voltage to the anode electrode via the sealing member, wherein the voltage supply unit comprises:

a connecting member for electrically connecting the sealing member to the anode electrode; and a supply member connected to the sealing member to supply the anode voltage to the sealing member, wherein the connecting member is connected with the anode electrode by a first electrically conductive adhesive layer, and wherein the connecting member is connected with the sealing member by a second electrically conductive adhesive layer.

2. The electron emission display of claim 1, wherein the connecting member comprises a lead line.

3. The electron emission display of claim 1, wherein the connecting member comprises an electrically conductive elastic body.

4. The electron emission display of claim 3, wherein the electrically conductive elastic body is a coil spring.

5. The electron emission display of claim 3, wherein the electrically conductive elastic body is a leaf spring having a bent centerline.

6. The electron emission display of claim 1, wherein the supply member of the voltage supply unit comprises a lead line connected with the sealing member and arranged on the first substrate.

7. An electron emission display, comprising:

a first substrate;

a second substrate facing the first substrate;

an electron emission unit arranged on the first substrate;

a light emission unit arranged on the second substrate, the light emission unit having an anode electrode for accelerating an electron beam emitted from the electron emission unit;

a sealing member for sealing an exhaust hole of the first substrate; and a voltage supply unit adapted to apply an anode voltage to the anode electrode via the sealing member, wherein the voltage supply unit comprises:

a connecting member for electrically connecting the sealing member to the anode electrode; and a supply member connected to the sealing member to supply the anode voltage to the sealing member, wherein the supply member of the voltage supply unit comprises a lead line connected with the sealing member and arranged on the first substrate, and wherein the lead line is connected with the sealing member by an electrically conductive adhesive layer.

8. The electron emission display of claim 1, wherein:

the supply member of the voltage supply unit comprises a first lead line connected with the sealing member and arranged on the first substrate, and the connecting member comprises a second lead line.

9. An electron emission display, comprising:

a first substrate;

a second substrate facing the first substrate;

an electron emission unit arranged on the first substrate;

a light emission unit arranged on the second substrate, the light emission unit having an anode electrode for accelerating an electron beam emitted from the electron emission unit;

a sealing member for sealing an exhaust hole of the first substrate; and a voltage supply unit adapted to apply an anode voltage to the anode electrode via the sealing member, wherein the voltage supply unit comprises:

a connecting member for electrically connecting the sealing member to the anode electrode; and a supply member connected to the sealing member to supply the anode voltage to the sealing member, wherein:

the connecting member is connected with the anode electrode by a first electrically conductive adhesive layer, the connecting member is connected with the sealing member by a second electrically conductive adhesive layer, the supply member of the voltage supply unit comprises a lead line connected with the sealing member and arranged on the first substrate, and the lead line is connected with the sealing member by a third electrically conductive adhesive layer.

10. The electron emission display of claim 1, wherein the sealing member comprises an electrically conductive material.

11. The electron emission display of claim 10, wherein the sealing member is formed of metal or a metal alloy.

12. The electron emission display of claim 1, wherein the sealing member is configured to have a hemispherical shape or a substantially flat shape.

13. The electron emission display of claim 12, wherein the sealing member is coupled to the first substrate by a frit deposited on a periphery of the sealing member.

14. The electron emission display of claim 1, wherein the electron emission unit comprises:

an electron emission region;

a plurality of cathode electrodes; and a plurality of gate electrodes arranged to cross the cathode electrodes, wherein the cathode electrodes and the gate electrodes are insulated from each other and adapted to control the electron emission region, and wherein the light emission unit comprises a plurality of phosphor layers and a black layer arranged between at least two of the phosphor layers.

15. The electron emission display of claim 14, wherein the electron emission region comprises a material selected from the group consisting of carbon nanotubes, graphite, graphite nanofibers, diamonds, diamond-like carbon, fullerene ($C_{60}$), silicon nanowires, and combinations thereof.

16. The electron emission display of claim 1, wherein the electron emission unit comprises FEA elements.

* * * * *